US006854824B2

(12) United States Patent
Sukigara

(10) Patent No.: US 6,854,824 B2
(45) Date of Patent: Feb. 15, 2005

(54) INKJET RECORDING APPARATUS

(75) Inventor: Akihiko Sukigara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/435,132

(22) Filed: May 12, 2003

(65) Prior Publication Data

US 2003/0214547 A1 Nov. 20, 2003

(30) Foreign Application Priority Data

May 14, 2002 (JP) ..... 2002-138091

(51) Int. Cl.[7] ..... B41J 2/165
(52) U.S. Cl. ..... 347/23; 347/30; 347/33
(58) Field of Search ..... 347/22–35, 14, 347/19

(56) References Cited

U.S. PATENT DOCUMENTS 5,793,388 A * 8/1998 Martinson et al. ..... 347/19
5,805,180 A * 9/1998 Ebisawa et al. ..... 347/23
6,036,299 A * 3/2000 Kobayashi et al. ..... 347/30
6,231,156 B1 * 5/2001 Ono ..... 347/24
6,382,784 B2 * 5/2002 Pawlowski, Jr. et al. ..... 347/23

* cited by examiner

*Primary Examiner*—Shih-wen Hsieh
(74) *Attorney, Agent, or Firm*—Fitzpatrick, Cella, Harper & Scinto

(57) ABSTRACT

The present invention relates to an inkjet recording apparatus for recording by discharging ink out of a recording head. The apparatus comprises a recovery apparatus for recovering the recording head in performing a conceptually lower recovery operation and a conceptually higher recovery operation including the conceptually lower recovery operation and a controller for controlling the operation of the recovery apparatus. In a case where the conceptually lower recovery operation is otherwise made, if a second condition not satisfying a first condition is satisfied even where the first condition for performing the conceptually higher recovery operation is not satisfied during the conceptually higher recovery operation, the conceptually higher recovery operation is performed without performing the conceptually lower recovery operation.

12 Claims, 5 Drawing Sheets

INKJET RECORDING APPARATUS

BACKGROUND OF THE INVENTION

1. Field of the Invention

This invention relates to an inkjet recording apparatus and, more particularly, to a recovery apparatus for performing recovery operations such as suction, empty suction, and wiping of the recording head.

2. Description of Related Background Art

Inkjet recording apparatuses, as known presently, effect recording such as letters and images on a sheet by discharging ink out of an inkjet recording head. The recording head may cause image defects due to inaccurate droplet discharges if ink is dried to clog the nozzle or ink stagnates around the outlet of the nozzle.

Various measures are taken conventionally in the inkjet recording apparatuses to discharge ink properly. First, orifices of the recording head are normally shut with a cap to prevent ink from drying. A preliminary discharge is made at a time of recording to remove clogging of the ink. Suction is made at every recording of a prescribed amount where the orifices are shut with the cap, thereby removing clogs in the nozzles which are unlikely to be eliminated by the preliminary discharge. Meanwhile, because ink may stagnate in the cap from the preliminary discharge, empty suction, in which suction is made in the cap while the orifices are not shut, clears the stagnation where the preliminary discharge is made in a prescribed amount. Wiping of the orifices with an elastic blade such as a rubber blade is made at every recording of a prescribed amount, thereby removing clogged ink around the orifices.

In the conventional art, the recovery operation of the recording head such as suction, empty suction, and wiping was controlled with respective timings. More specifically, the empty suction operation is included in the suction operation because the empty suction operation is unnecessary where the suction operation is made. The wiping operation is included in the empty suction operation, and namely, the wiping operation can be made solely, but wiping is also done where the empty suction operation is made. This is because wiping is necessary at the orifices since the preliminary discharge is made at the empty suction operation.

FIG. 5 is a timing chart showing an example of a relation between three recovery operations and normal values for determining the timings for the operations in a conventional recording apparatus. In FIG. 5, the time proceeds vertically, from the upper side to the lower side. Time T101 is a start time; a situation that, from the left side, all of wiping dot count, preliminary discharge amount in cap, and suction dot count is zero, is shown. Those three counters are independently operated, and a description here is made in extracting the operations active at the same time.

At time T102, since the wiping dot count reaches the normal value 5, the wiping operation is made, and the wiping dot count is cleared. At time T103, again, where the wiping dot count reaches the normal value 5, the wiping operation is made, and the wiping dot count is cleared. At time T104, the preliminary discharge amount in the cap is saturated and becomes the normal value 3 or more, and the empty suction is done. Because the wiping is done at the same time upon operation of the empty suction, the wiping dot count is cleared, and the recovery is restarted upon clearing the preliminary discharge amount in the cap.

At time T105, since the wiping dot count reaches the normal value 5, the wiping operation is made, and the wiping dot count is cleared. At time T106, again, where the wiping dot count reaches the normal value 5, the wiping operation is made, and the wiping dot count is cleared. At time T107, the preliminary discharge amount in the cap is saturated and becomes the normal value 3 or more, and the empty suction is done. Because the wiping is done at the same time upon operation of the empty suction, the wiping dot count is cleared, and the recovery is restarted upon clearing the preliminary discharge amount in the cap. Subsequently, at time T108, the suction dot count becomes the normal value 1, and the suction operation is made. The empty suction and wiping are done at the same time when the suction is made, and the preliminary discharge amount in the cap and the wiping dot count are cleared to restart the operations.

At time T109, since the wiping dot count reaches the normal value 5, the wiping operation is made, and the wiping dot count is cleared. At time T110, again, where the wiping dot count reaches the normal value 5, the wiping operation is made, and the wiping dot count is cleared. At time T111, the preliminary discharge amount in the cap is saturated and becomes the normal value 3 or more, and the empty suction is done. Because the wiping is done at the same time upon operation of the empty suction, the wiping dot count is cleared, and the recovery is restarted upon clearing the preliminary discharge amount in the cap.

At time T112, since the wiping dot count reaches the normal value 5, the wiping operation is made, and the wiping dot count is cleared. At time T113, again, where the wiping dot count reaches the normal value 5, the wiping operation is made, and the wiping dot count is cleared. At time T114, the preliminary discharge amount in the cap is saturated and becomes the normal value 3 or more, and the empty suction is done. Because the wiping is done at the same time upon operation of the empty suction, the wiping dot count is cleared, and the recovery is restarted upon clearing the preliminary discharge amount in the cap. Subsequently, at time T115, the suction dot count becomes the normal value 1, and the suction operation is made. The empty suction and wiping are done at the same time when the suction is made, and the preliminary discharge amount in the cap and the wiping dot count are cleared to restart the operations.

As described above, in this prior art shown in FIG. 5, two of the recovery operations, wiping and empty suction, during time T103 to T104 and T110 to T111, are executed at the same time. Also, three of the recovery operations, wiping, empty suction, and suction, during time T106 to T108 and T113 to T115, are executed at the same time.

That is, in the prior art, the recovery operation is overly done within a very short period of time such as the empty suction being done immediately after the wiping operation is made or the head being suctioned immediately after the empty suction is made, even where the wiping operation is included in the empty suction operation and where the empty suction is included in the suction operation. Therefore, the prior art raised problems in that the processing efficiency and throughput were reduced.

SUMMARY OF THE INVENTION

It is an object of the invention to provide an inkjet recording apparatus controlling not to execute recovery operations in an overlapping manner within a short period of time in aiming at improvements on the processing efficiency and throughput.

It is another object of the invention to provide an inkjet recording apparatus for recording by discharging ink out of a recording head, including: a recovery apparatus for recovering the recording head; and a controller for controlling the operation of the recovery apparatus, wherein the recovery apparatus performs a conceptually lower recovery operation and a conceptually higher recovery operation including the conceptually lower recovery operation, and in a case where the conceptually lower recovery operation is otherwise made, if a second condition not satisfying a first condition is satisfied even where the first condition for performing the conceptually higher recovery operation is not satisfied during the conceptually higher recovery operation, the conceptually higher recovery operation is performed without performing the conceptually lower recovery operation.

To solve the above problems, a representative structure of the inkjet recording apparatus according to the invention, includes a recording head for recording upon discharging ink, and recovering means for recovering the recording head, wherein plural recovery operations are made using the recovering means in performing a conceptually higher recovery operation including a conceptually lower recovery operation, having, with respect to the conceptually higher recovery operation, a first condition for performing the operation and a second condition not satisfying the first condition, and performing the conceptually higher recovery operation without performing the conceptually lower recovery operation where the second condition is satisfied even though the first condition is not satisfied for the conceptually higher recovery operation where the condition is satisfied for performing the conceptually lower recovery operation.

As described above, with the inkjet recording apparatus according to the invention, the apparatus determines the condition of the conceptually higher recovery operation including the conceptually lower recovery operation at a time performing the recovery operations such as suction operation of the head, empty suction operation, and wiping operation, and performs the conceptually higher recovery operation where the second condition slightly dissatisfying the first condition is satisfied even where the first condition for the conceptually higher recovery operation is not satisfied, thereby controlling not to execute overly the same recovery operation in a short period of time, and thereby improving the processing efficiency and throughput.

DETAILED DESCRIPTION OF THE PREFERRED EMBODIMENTS

Figure 1:
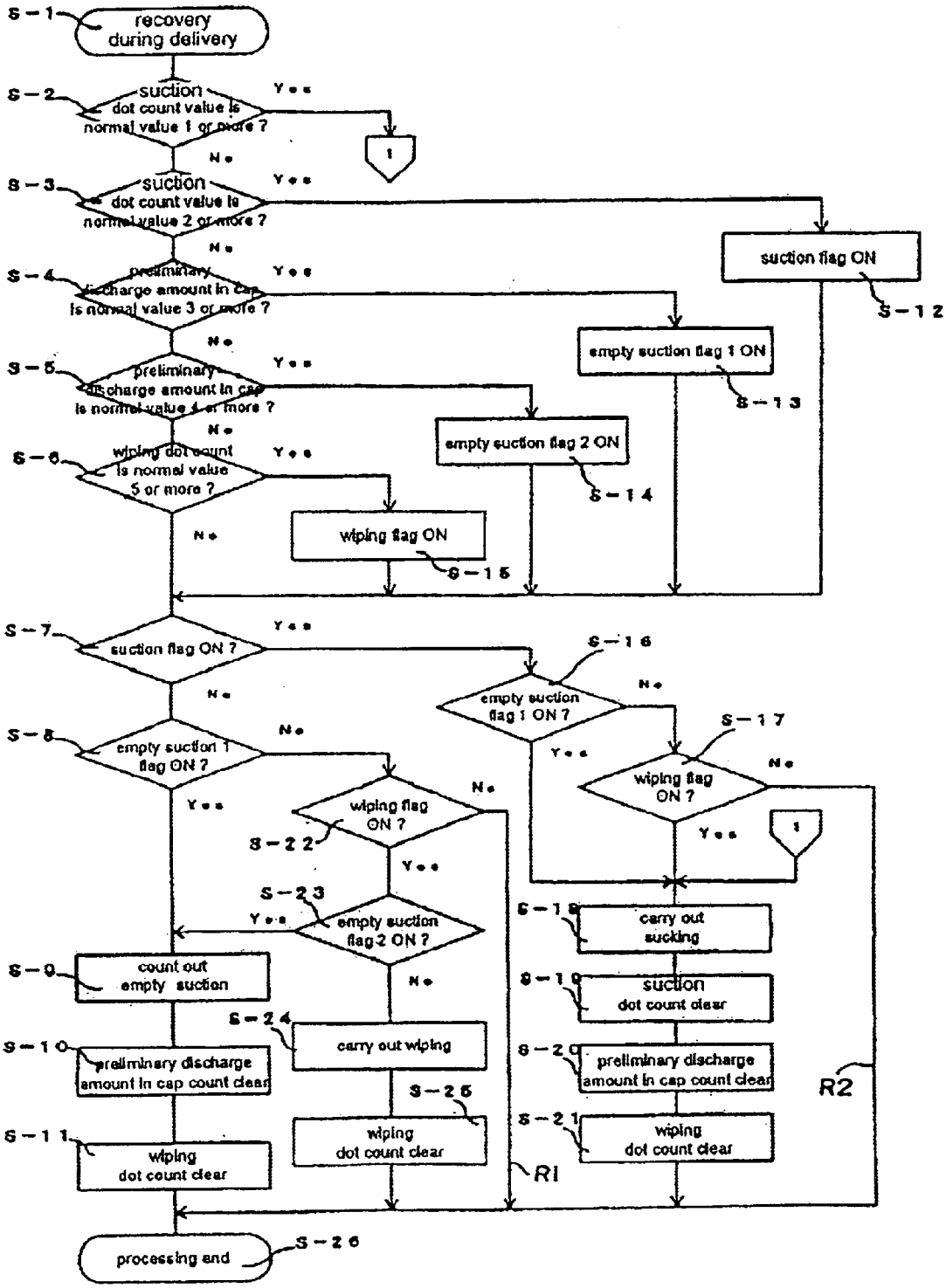
FIG. 1 is a flowchart describing recovery processing operations during sheet delivery.
Figure 2:
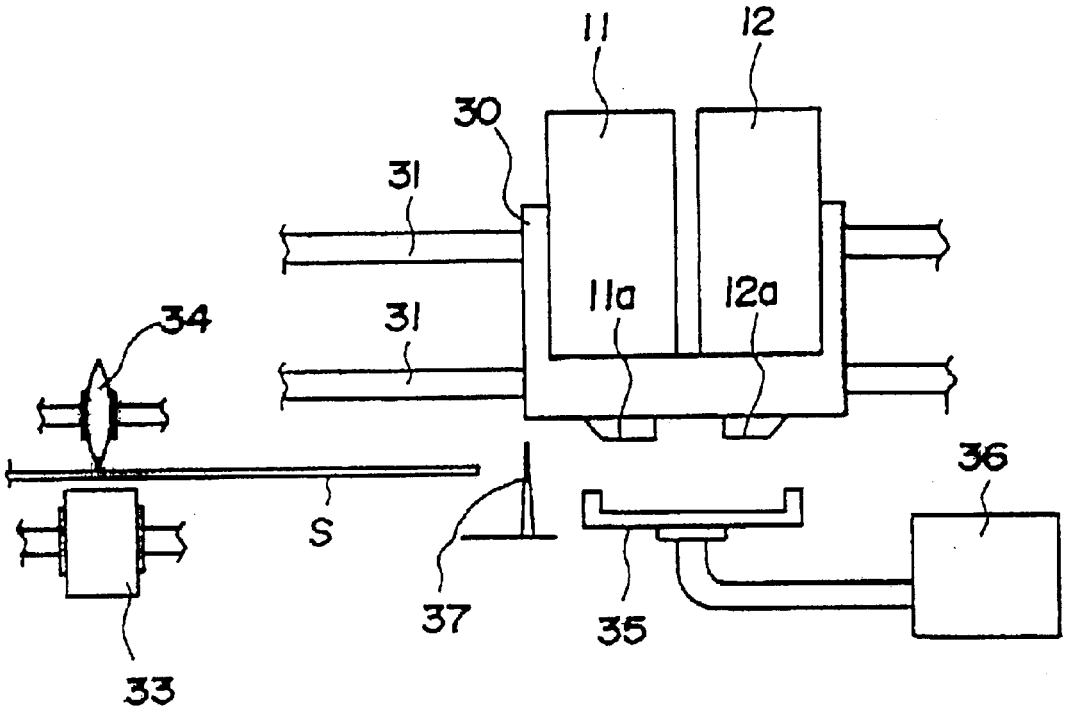
FIG. 2 is a schematic view of an essential portion of an inkjet recording apparatus.
Figure 3:
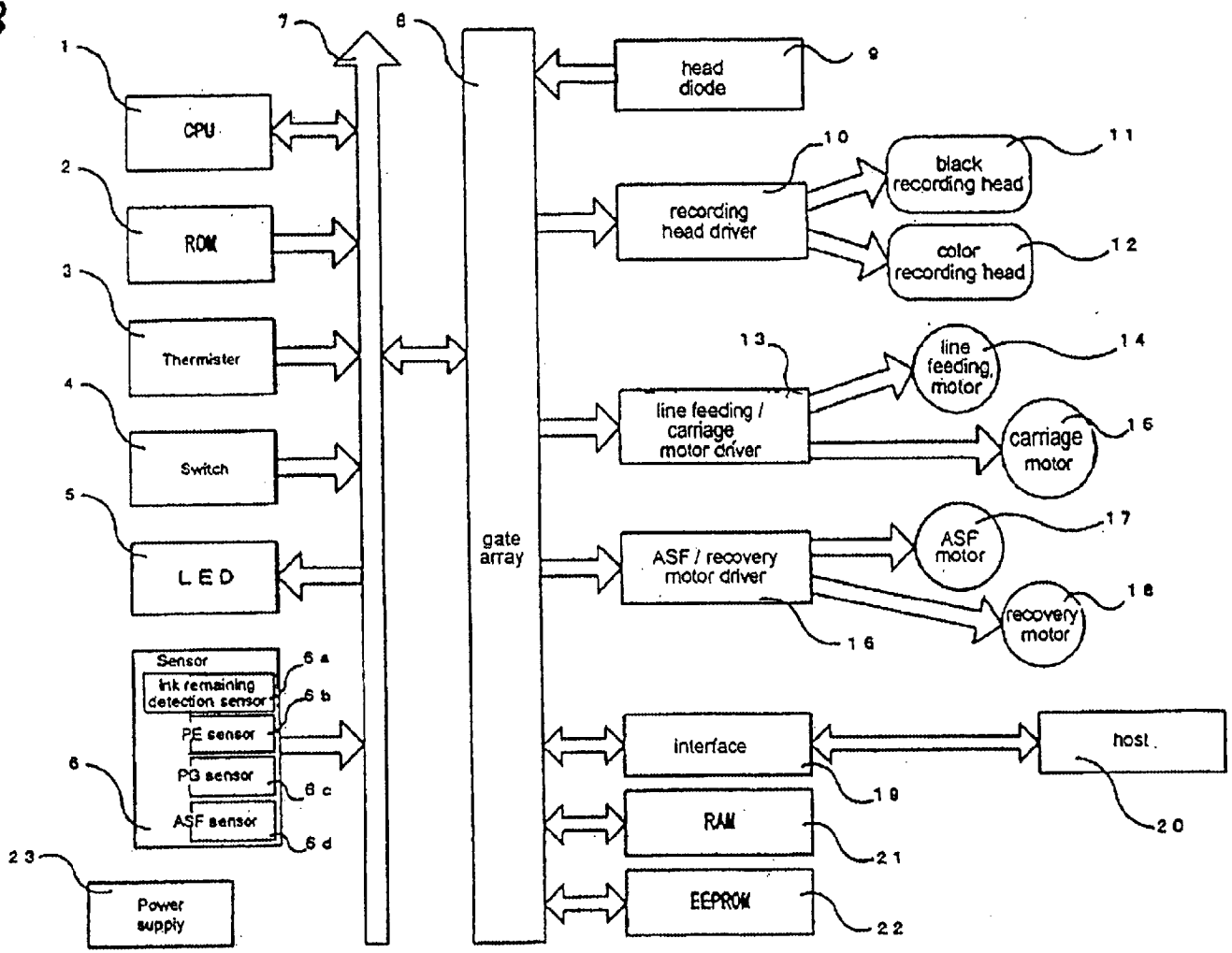
FIG. 3 is a control block diagram of the inkjet recording apparatus.
Figure 4:
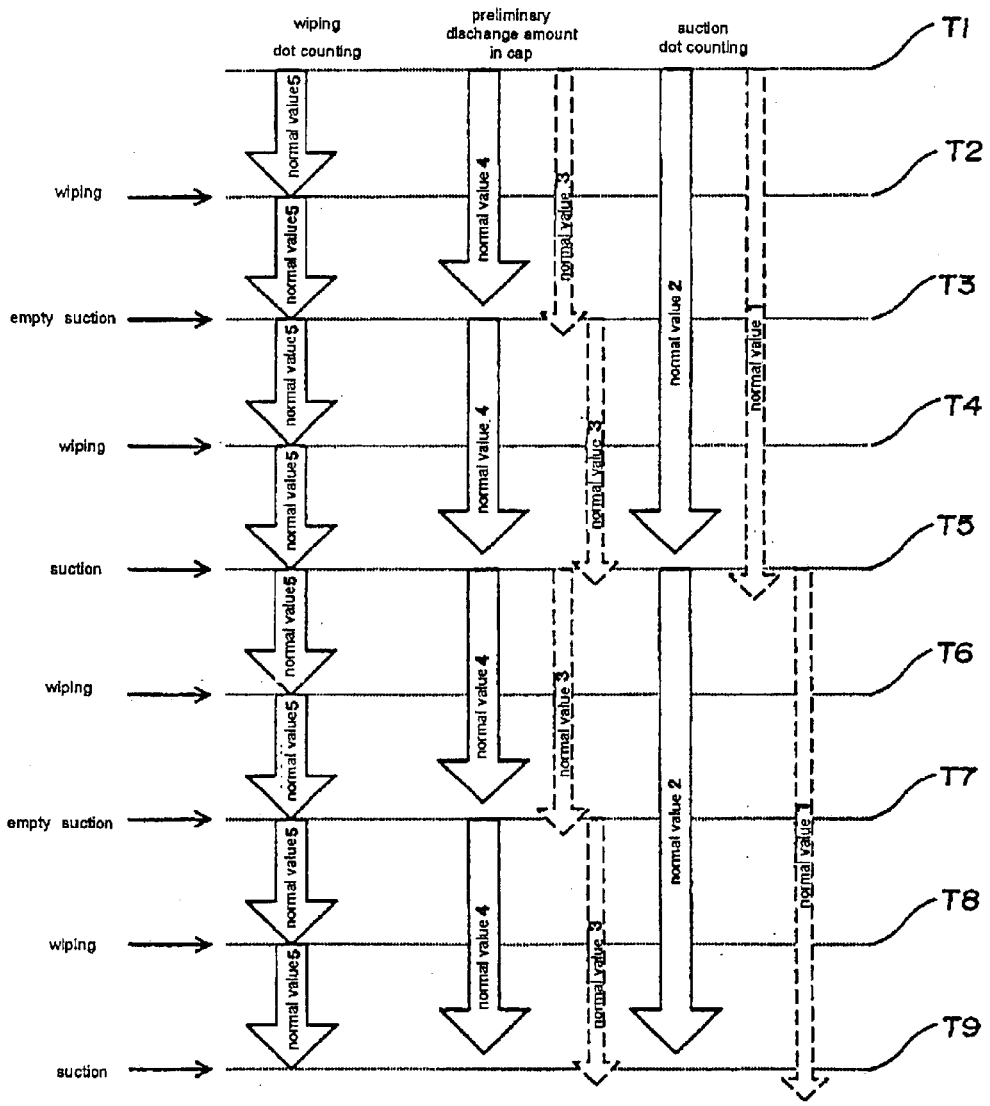
FIG. 4 is a timing chart showing an example of a relation between three recovery operations and normal values for determining the timings for the operations.
Figure 5:
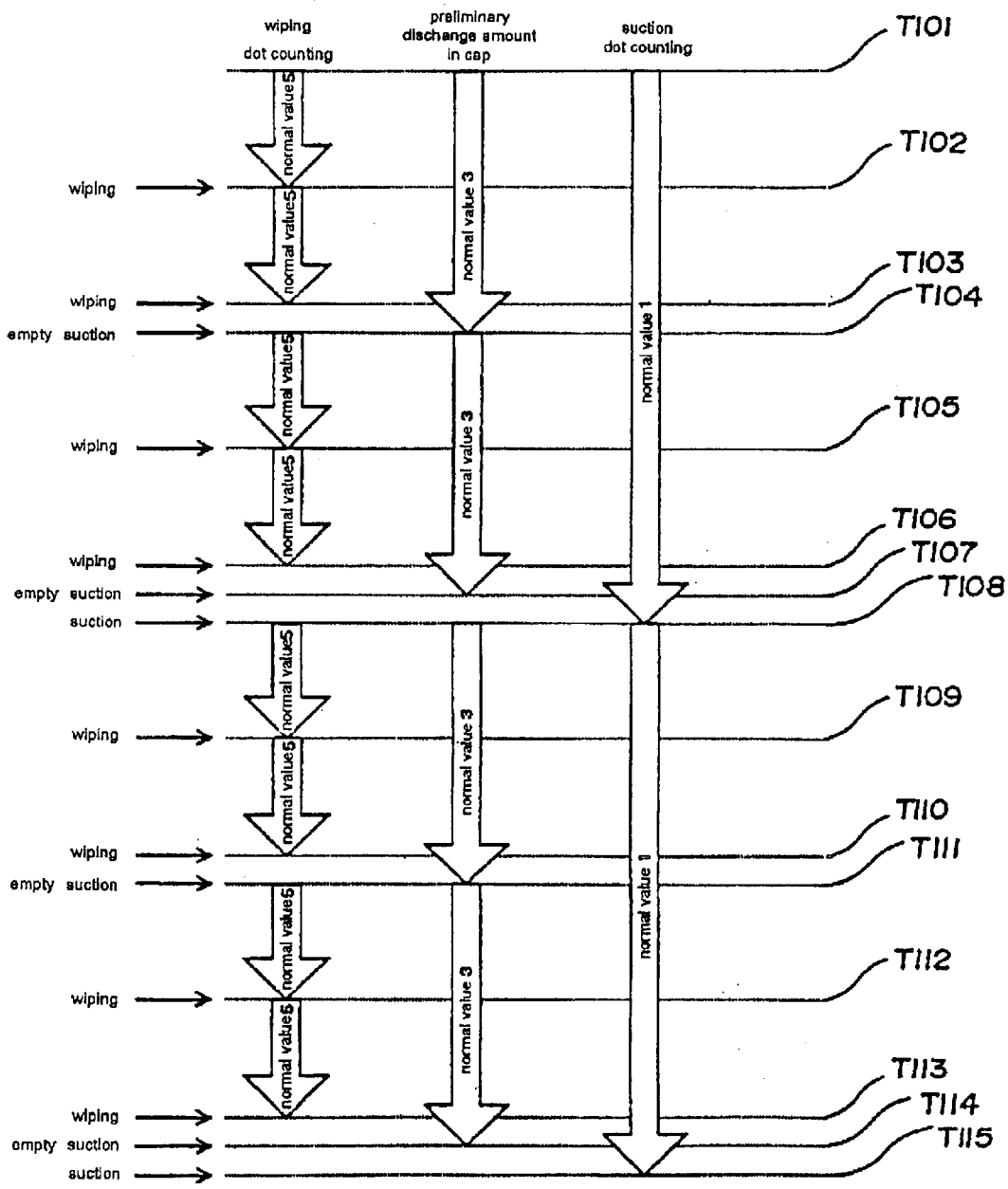
FIG. 5 is a timing chart showing an example of a relation between three recovery operations and normal values for determining the timings for the operations in a conventional recording apparatus.

Referring to the drawings, an embodiment of the inkjet recording apparatus according to the invention is described. FIG. 1 is a flowchart describing recovery processing operations during sheet delivery; FIG. 2 is a schematic view of an essential portion of the inkjet recording apparatus; FIG. 3 is a control block diagram of the inkjet recording apparatus; FIG. 4 is a timing chart showing an example of a relation between three recovery operations and normal values for determining the timings for the operations.

Apparatus Structure

As shown in FIG. 2, the inkjet recording apparatus according to this embodiment has a carriage 30 movable in a main scanning direction along a shaft 31 mounting a black recording head 11 and a multicolor recording head 12, and discharges ink out of respective orifices 11*a*, 12*a* to make recording of images for one line. A sheet S is intermittently conveyed by one line with a conveyance roller 33 and a conveyance roller 34 to make recording images on the entire sheet S.

A cap 35 for shutting the orifices 11*a*, 12*a* is formed at home positions of the recording heads 11, 12. The cap 35 can come closer to and remote from the orifices 11, 12 by a moving mechanism, not shown, and shuts the orifices 11, 12 while not recording any image to prevent the ink from drying. A pump 36 is coupled to the cap 35 and is structured to suction the ink and air in the cap. An elastic blade 37 is equipped at the home position to perform the wiping operation on the orifices.

As shown in FIG. 3, a CPU (central processing unit) 1 such as a programmable microprocessor in the recording apparatus is installed. A ROM 2 stores font data, program instruction sequences executed at the CPU 1 for controlling the recording apparatus system, and various type control tables. A RAM 21 stores various recording data sent from a host computer 20 through an interface 19 in a print buffer in the RAM 21 for printing out with the black recording head 11 and the multicolor recording head 12 while the CPU 1 executes the program stored in the ROM 2.

A gate array 8 serving as a control logic controls a recording head driver 10 for outputting the control signal for nozzles in the recording heads 11, 12, further controls data transmissions among the interface 19, the CPU 1, and the RAM 21, and has a control logic for motor drivers 13, 16.

In the recording apparatus, the CPU 1 connecting to a CPU bus 7, and the interface 19 interacting between the recording apparatus and the host computer 20 are incorporated. The interface 19 has a signal route transmitting and receiving signals in bidirectional ways and transmits and receives recording data and commands to and from the host computer 20.

A motor driver 13 for line feeding and carriage movement governs the control of the two motors (line feeding motor 14, carriage motor 15). The line feeding motor 14 controls the sheet feeding and the supply and delivery of the sheet by drive of the conveyance roller 33. The carriage motor 15 drives a carriage 30 to control the movement of the recording heads 11, 12 to a recording position on the scanned line. A motor diver 16 for ASF and recovery also governs the control of two motors (ASF motor 17, recovery motor 18). The ASF motor 17 controls picking up in the sheet feeding. The recovery motor 18 controls recovery operations of the recording heads 11, 12 such as cleaning, wiping, and capping. The black recording head 11 and the multicolor recording head 12 controlled by the recording head driver 10 are detachable units moved by the carriage, and these recording heads contain ink discharging nozzles for forming recording images on the recording medium and head diodes 9 for feeding back the information relating to existence and properties of the detachable recording heads.

Based on electrical signals sent from the recording head driver 10, the electro-thermal converting devices of the recording heads 11, 12 are driven, thereby generating the thermal energy to induce film boiling in the ink. Since the ink discharge amount is shifted according to the temperature of the recording heads 11, 12, the temperature output of the thermistor 3 for measuring surrounding temperature in the recording apparatus and the head diode 9 in the recording heads 11, 12 is monitored.

An EEPROM 22 is a non-volatile memory for storing print information such as recording head structure, recording head alignment parameters, recording head drive parameters, drive history of the motors, recovery history of the heads, ink consumption amount history, error occurrence state history, paper passing history, user's use state history, and ink status in the ink cartridge.

Various kinds of sensors 6 are mounted on the recording apparatus. The ink remaining detection sensor 6*a* is an optical sensor, and ink existence in the ink tank is detected by transmittance of light when the ink tank mounted on the carriage 30 passes over the sensor by moving the carriage 30. A PE sensor (paper end sensor) 6*b* detects the passing sheet. A PG sensor (purge sensor) 6*c* detects the cam position of the recovery unit of the recording head. An ASF sensor (feeding sensor) 6*d* detects the rotary position of the cam in the feeding unit. Other than the above, a cover sensor, sensors such as an encoder for reading the positional information of the carriage, and an encoder for reading the positional information of LF are contained herein. Switches 4 for user manipulation such as a power switch, and a resuming switch are installed. An LED 5 for display to inform the state of the recording apparatus of the user is also installed. A power source 23 supplies a power source for driving the recording apparatus.

Control of Recovery Operation

Next, recovery operations in the inkjet recording apparatus thus structured are described. In this embodiment, three kinds, i.e., suction operation, empty suction operation, and wiping operation, are performed as the recovery operations. The empty suction operation is a conceptually higher recovery operation than the wiping operation, and when the empty suction is performed, the wiping operation is also done as the conceptually lower recovery operation. In substantially the same manner, the suction operation is a conceptually higher recovery operation than the empty suction operation, and when the suction operation is done, the empty suction operation as the conceptually lower recovery operation, as well as the wiping operation, are performed.

The suction operation is for suctioning of the orifices 11*a*, 12*a* with the pump 36 while the orifices 11*a*, 12*a* are shut by the cap 35, in substantially the same manner as in the prior art, to remove clogs in the nozzles which are not removed in a preliminary discharge. The empty suction operation is for suctioning of the interior of the cap 35 while the orifices 11*a*, 12*a* are not shut by the cap 35 and removing the ink stagnated in the cap 35 by the preliminary discharge. The wiping operation is for removing ink stagnated around the orifices by wiping the orifices 11*a*, 12*a* with the elastic blade 37.

The suction operation is done basically by counting dots of the ink discharged for recording and by being executed when the counted value reaches the normal value 1 as a first condition, but also executed when satisfying the normal value 2 as a second condition. The empty suction operation is basically executed when the amount of the ink preliminary discharged in the cap reaches the normal value 3 as the first condition, but also executed when the amount satisfies the normal value 4 as the second condition. The wiping operation is done by counting dots of the ink discharged for recording and by being executed when the counted value reaches the preset normal value 5. The execution timings for those recovery operations are controlled with a sequence described below. In the suction dot count value, the normal value 1 is larger than the normal value 2. In the preliminary discharge amount in the cap, the normal value 3 is larger than the normal value 4.

In FIG. 1, a program stored in the ROM 2 (see, FIG. 3) for recovery operation during delivery of the recording sheet is started (S1). First, a determination is made as to whether a suction dot count value is the normal value 1 as the first condition or more (S2). If the value is the normal value 1 or more, the operation transits to step S18.

If the suction dot count value is not the normal value 1 or more at S2, a determination is made as to whether the suction dot count value is the normal value 2 as a second condition for the suction operation or more (S3). If the value is the normal value 2 or more, a "suction flag" is turned on (S12), and the operation moves to S7.

If the suction dot count value is not the normal value 2 or more at S3, a determination is made as to whether the preliminary discharge amount in the cap is the normal value 3 as the first condition for the empty suction operation or more (S3). If the value is the normal value 3 or more, an "empty suction flag" is turned on (S13), and the operation moves to S7.

If the preliminary discharge amount in the cap is not the normal value 3 or more at S4, a determination is made as to whether the preliminary discharge amount in the cap is the normal value 4 as the second condition for the empty suction operation or more (S5). If the value is the normal value 4 or more, an "empty suction flag 2" is turned on (S14), and the operation moves to S7.

If the preliminary discharge amount in the cap is not the normal value 4 or more at S5, a determination is made as to whether a wiping dot count is the normal value 5 or more (S6). If the value is the normal value 5 or more, a "wiping flag" is turned on (S15), and the operation moves to S7.

At S7, a determination is made as to whether the "suction flag" is turned on. Where the "suction flag" is turned on, the "empty suction flag" is searched (S16), and subsequently the "wiping flag" is searched (S17). If any one of the flags is turned on, the suction operation is executed (S18), and the suction dot count is cleared (S19). Where the suction operation is made at S18, the count of the preliminary discharge amount in the cap is cleared since the empty suction operation is no longer necessary (S20). In substantially the same way, since the wiping operation is no longer necessary, the wiping dot count is cleared (S21), thereby finishing the processing (S26). If both of the "empty suction flag 1" and the "wiping flag" are not turned on, the processing ends without performing the recovery operation (S26).

At S7, if the "suction flag" is not turned on, a determination is made as to whether the "empty suction flag 1" is turned on (S8). If it is not turned on, a determination is made as to whether the "wiping flag" is turned on (S22). If the "wiping flag" is not turned on, the processing ends (S26). At S22, if the "wiping flag" is turned on, a determination is made as to whether the "empty suction flag 2" is turned on (S23). If it is turned on, the processing moves to S9. If the "empty suction flag 2" is not turned on, the wiping operation is executed (S24), and the processing ends (S26) upon clearing the wiping dot count (S25).

Returning to S8, where the "empty suction flag 1" is turned on, the empty suction operation is executed (S9), and the count of the preliminary discharge amount in the cap is cleared (S10). Since the empty suction operation is executed, the wiping dot count is cleared (S11), and the processing ends (S26).

That is, according to the above control, where the condition of the empty suction operation or the wiping operation as the conceptually lower recovery operation is satisfied (S16, S17), the suction operation as the conceptually higher recovery operation is performed (S18) without performing the empty suction operation or the wiping operation as the conceptually lower recovery operation in a case where the second condition is satisfied (S7) even where the first condition for the suction operation as the conceptually higher recovery operation is not satisfied (S2).

In substantially the same manner, where the condition of the wiping operation as the conceptually lower recovery operation is satisfied (S22), the empty suction operation as the conceptually higher recovery operation is performed (S9) without performing the wiping operation as the conceptually lower recovery operation in a case where the second condition is satisfied (S23) even where the first condition for the suction operation as the conceptually higher recovery operation is not satisfied (S8).

According to the above control for recovery operations, the recovery operations are controlled as four patterns, in a case that the suction operation is executed (S18), that the empty suction operation is executed (S9), that the wiping operation is executed (S24), and that no recovery operation is executed (R1, R2), and the recovery operations of the plural kinds cannot be executed overly.

FIG. 4 is a timing chart showing an example of a relation between three recovery operations and normal values for determining the timings for the operations. The time proceeds vertically, from the upper side to the lower side. Time T1 is a start time; a situation that, from the left side, all of wiping dot count, preliminary discharge amount in the cap, and suction dot count is zero is shown. Those three counters are independently operated, and a description here is made in extracting the operations active at the same time.

At time T2, since the wiping dot count reaches the normal value 5, the wiping operation is made, and the wiping dot count is cleared. At time T3, again, the wiping dot count reaches the normal value 5. At that time, the preliminary discharge amount in the cap does not reach the normal value 3, but since it is the normal value 4 or more, the empty suction operation is made as described above. If the empty suction operation is made, the wiping operation is also made at the same time, and then, the wiping dot count and the preliminary discharge amount in the cap are cleared, before the recovery operations are restarted.

At time T4, since the wiping dot count reaches the normal value 5, the wiping operation is made, and the wiping dot count is cleared. At time T5, again, the wiping dot count reaches the normal value 5. At that time, the preliminary discharge amount in the cap does not reach the normal value 3, but is the normal value 4 or more. The suction dot count does not reach the normal value 1, but is the normal value 2 or more. Since the empty suction operation contains the wiping operation, and since the suction operation contains the empty suction operation, the suction operation is executed at time T5. Where the suction operation is made, the empty suction operation and the wiping operation are executed at the same time, and where the wiping dot count, the preliminary discharge amount in the cap, and the suction dot count are cleared, the recovery operations are restarted.

At time T6, since the wiping dot count reaches the normal value 5, the wiping operation is made, and the wiping dot count is cleared. At time T7, again, the wiping dot count reaches the normal value 5. At that time, the preliminary discharge amount in the cap does not reach the normal value 3, but is the normal value 4 or more, so that the empty suction operation is executed. Where the empty suction operation is made, the wiping operation is executed at the same time, and where the wiping dot count and the preliminary discharge amount in the cap are cleared, the recovery operations are restarted.

At time T8, since the wiping dot count reaches the normal value 5, the wiping operation is made, and the wiping dot count is cleared. At time T9, again, the wiping dot count reaches the normal value 5. At that time, the preliminary discharge amount in the cap does not reach the normal value 3, but is the normal value 4 or more. The suction dot count does not reach the normal value 1, but is the normal value 2 or more. Since the empty suction operation contains the wiping operation, and since the suction operation contains the empty suction operation, the suction operation is executed at time T9. Where the suction operation is made, the empty suction operation and the wiping operation are executed at the same time, and where the wiping dot count, the preliminary discharge amount in the cap, and the suction dot count are cleared, the recovery operations are restarted.

As described above, the three recovery operations, i.e., the wiping operation, the empty suction operation, and the suction operation, are not executed within a short period of time successively, and the conceptually lower recovery operation is not executed overly.

As described above, with the inkjet recording apparatus according to the embodiment, the apparatus determines the condition of the conceptually higher recovery operation including the conceptually lower recovery operation at a time of performing the recovery operations such as suction operation of the recording head, empty suction operation, and wiping operation, and performs the conceptually higher recovery operation where the second condition not satisfying the first condition is satisfied even where the first condition for the conceptually higher recovery operation is not satisfied, thereby controlling not to execute overly the same recovery operation within a short period of time, and thereby improving the processing efficiency and throughput.

What is claimed is:

1. An inkjet recording apparatus for recording by discharging ink from a recording head, comprising:

a recovery apparatus for recovering the recording head by performing a conceptually lower recovery operation and a conceptually higher recovery operation including the conceptually lower recovery operation; and a controller for controlling the operation of the recovery apparatus, wherein, in a case where the conceptually lower recovery operation is otherwise made, if a second condition not satisfying a first condition is satisfied even where the first condition for performing the conceptually higher recovery operation is not satisfied during the conceptually higher recovery operation, the conceptually higher recovery operation is performed without performing the conceptually lower recovery operation.

2. The inkjet recording apparatus according to claim 1, wherein the conceptually higher recovery operation is an empty suction operation, while the conceptually lower recovery operation is a wiping operation.

3. The inkjet recording apparatus according to claim 1, wherein the conceptually higher recovery operation is a suction operation, while the conceptually lower recovery operation is an empty suction operation.

4. The inkjet recording apparatus according to claim 1, wherein the recovery operations are a suction operation, an empty suction operation, and a wiping operation, and the suction operation is a conceptually higher recovery operation relative to the empty suction operation, while the empty suction operation is a conceptually higher recovery operation relative to the wiping operation.

5. The inkjet recording apparatus according to claim 3, wherein a condition for performing the suction operation is based on a count value of dots of ink discharged for recording where the count value of the first condition is greater than the count value of the second condition, wherein a condition for performing the empty suction operation is based on an ink amount preliminarily discharged in a cap for shutting an orifice of the recording head where an amount for the first condition is larger than an amount for the second condition, and wherein a condition for performing a wiping operation is based on a count value of ink discharged for recording.

6. The inkjet recording apparatus according to claim 4, wherein at a time that the suction operation is made, the empty suction operation and the wiping operation are performed at the same time to restart the recovery operations where clearing a count value is the condition for performing the suction operation, the ink amount is the condition for performing the empty suction operation, and the count value is the condition for performing the wiping operation, wherein at a time that the empty suction operation is made, the wiping operation is performed at the same time to restart the recovery operations where clearing the ink amount is the condition for performing the empty suction operation and the count value is the condition for performing the wiping operation, and wherein at a time that the wiping operation is made, the recovery operations are restarted where clearing the count value is the condition for performing the wiping operation.

7. An inkjet recording apparatus comprising:

a recording head for recording by discharging ink from a nozzle; and a plurality of recovery means for removing a clog at the nozzle, wherein the plurality of the recovery means implement recovery operations of plural kinds ranked from a conceptually higher recovery operation to a conceptually lower recovery operation, wherein an individual condition to judge as to whether a recovery operation is to be effected from the respective recovery operations is provided, wherein, for execution of the conceptually higher recovery operation, a first condition in which an individual judgment is made for inevitably performing the conceptually higher recovery operation, and a second condition for performing the conceptually higher recovery operation in a case where an individual judgment is made for performing the conceptually lower recovery operation though not satisfying the first condition, are provided, and wherein the conceptually higher recovery operation is performed without performing the conceptually lower recovery operation in a case where the individual judgment for the conceptually lower recovery operation is made while the second condition is satisfied.

8. The inkjet recording apparatus according to claim 7, wherein the conceptually higher recovery operation is an empty suction operation, while the conceptually lower recovery operation is a wiping operation.

9. The inkjet recording apparatus according to claim 7, wherein the conceptually higher recovery operation is a suction operation, while the conceptually lower recovery operation is an empty suction operation.

10. The inkjet recording apparatus according to claim 7, wherein the recovery operations are a suction operation, an empty suction operation, and a wiping operation, and the suction operation is a conceptually higher recovery operation relative to the empty suction operation, while the empty suction operation is a conceptually higher recovery operation relative to the wiping operation.

11. The inkjet recording apparatus according to claim 9, wherein a condition for performing the suction operation is based on a count value of dots of ink discharged for recording where the count value of the first condition is greater than the count value of the second condition, wherein a condition for performing the empty suction operation is based on an ink amount preliminarily discharged in a cap for shutting an orifice of the recording head where an amount for the first condition is larger than an amount for the second condition, and wherein a condition for performing a wiping operation is based on a count value of ink discharged for recording.

12. The inkjet recording apparatus according to claim 10, wherein at a time that the suction operation is made, the empty suction operation and the wiping operation are performed at the same time to restart the recovery operations where clearing a count value is the condition for performing the suction operation, an ink amount is the condition for performing the empty suction operation, and the count value is the condition for performing the wiping operation, wherein at a time that the empty suction operation is made, the wiping operation is performed at the same time to restart the recovery operations where clearing the ink amount is the condition for performing the empty suction operation and the count value is the condition for performing the wiping operation, and wherein at a time that the wiping operation is made, the recovery operations are restarted where clearing the count value is the condition for performing the wiping operation.

* * * * *

UNITED STATES PATENT AND TRADEMARK OFFICE

CERTIFICATE OF CORRECTION

PATENT NO. : 6,854,824 B2
DATED : February 15, 2005
INVENTOR(S) : Sukigara

It is certified that error appears in the above-identified patent and that said Letters Patent is hereby corrected as shown below:

Title page,
Item [56], References Cited, U.S. PATENT DOCUMENTS,
"6,382,784 B2 * 5/2002 Pawloski, Jr. et al. ….. 347/23" should read
-- 6,382,764 B1 * 5/2002 Shimoda …… 347/23 --.

Column 5,
Line 67, "preliminary" should read -- preliminarily --.

Signed and Sealed this

Thirtieth Day of August, 2005

JON W. DUDAS
*Director of the United States Patent and Trademark Office*